United States Patent [19]

Peterson

[11] 4,440,376

[45] Apr. 3, 1984

[54] EARTH SHELTERED BUILDING TECHNOLOGY

[76] Inventor: Richard E. Peterson, 412 Pierce Ave., #3, St. Paul, Minn. 55104

[21] Appl. No.: 185,560

[22] Filed: Sep. 9, 1980

[51] Int. Cl.[3] ..... E04G 11/06

[52] U.S. Cl. ..... 249/18; 249/34; 249/47

[58] Field of Search ..... 249/18, 19, 34, 32, 249/47

[56] References Cited

U.S. PATENT DOCUMENTS

| | | | |
|---|---|---|---|
| D. 133,658 | 9/1942 | Neff | D13/1 |
| D. 167,565 | 8/1952 | Feld | D13/1 |
| 744,199 | 11/1903 | Hubbell | 52/80 |
| 1,535,023 | 4/1925 | Kelley | 249/155 |
| 2,365,145 | 12/1944 | Neff | 72/1 |
| 2,469,603 | 5/1949 | Tourneau | 72/1 |
| 3,291,436 | 12/1966 | Berghammer | 249/26 |
| 3,703,271 | 11/1972 | Kamb | 249/162 |
| 4,136,849 | 1/1979 | Abercrombie | 249/160 |
| 4,151,975 | 5/1979 | Williams | 249/47 |

OTHER PUBLICATIONS

*Earth Shelter Digest,* No. 5, Sep./Oct. 1979 Issue "Spirited Group Tests Elliptical Dome", pp. 14, 15 and 41.

*Earth Shelter* 2; Earth Sheltered Housing Conference & Exhibition. Paper entitled, "Steel Reinforced Concrete Shell Structures: Forming Techniques, Structural Design, and Earth Sheltered Applications" presented by Michael R. Sullivan in Apr. 1980. pp. 161–171 of collected papers.

*Primary Examiner*—John A. Parrish

*Attorney, Agent, or Firm*—Anthony G. Eggink

[57] ABSTRACT

The earth sheltered building consists of a thin elliptoidal shell which is attached to a generally curvilinear top viewed foundation. The elliptoidal shell meets the foundation at a generally horizontal latitudinal plane which is spacially below and parallel to the equatorial plane of the elliptoid. The building has ingress and egress means defined generally by the intersection of a pair of latitudinal lines and a pair of longitudinal lines of the elliptoid. Ingress and egress means can also be obtained by the omission of any meridian surface section of the elliptoid or any section defined by a plane spacially parallel to a meridian plane. The building can also be elongated by placing a vaulted section of elliptic vertical cross section congruous with two hemi-elliptoidal shells. The building can be constructed by the use of predetermined inner and outer form panels which assemble into inner and outer form networks. These networks are spacially parallel and result in a form system having concavo-convex cavities into which building material is placed. The resultant thin shell elliptoidal structure from the use and method of use of the inner and outer form networks is optimal in distributing the forces that result when the structure is sheltered with earth components such as dirt, gravel, berming, etc. while, simultaneously, providing an interior space which can be optimally utilized for habitation.

10 Claims, 9 Drawing Figures

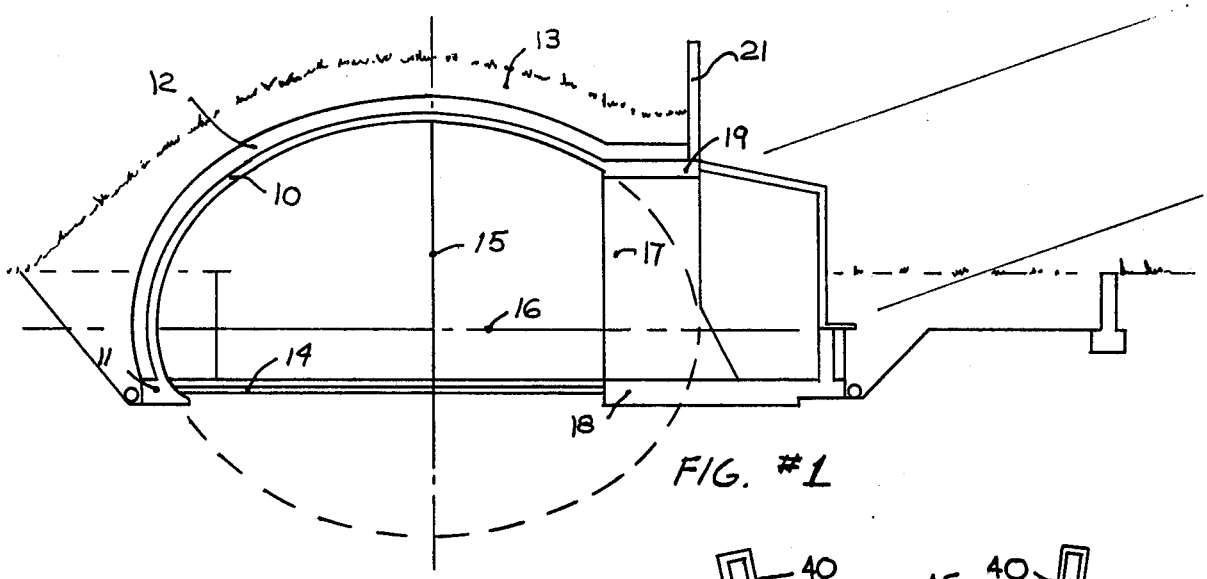
FIG. #1
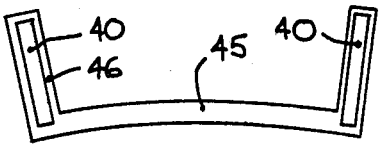
FIG #2
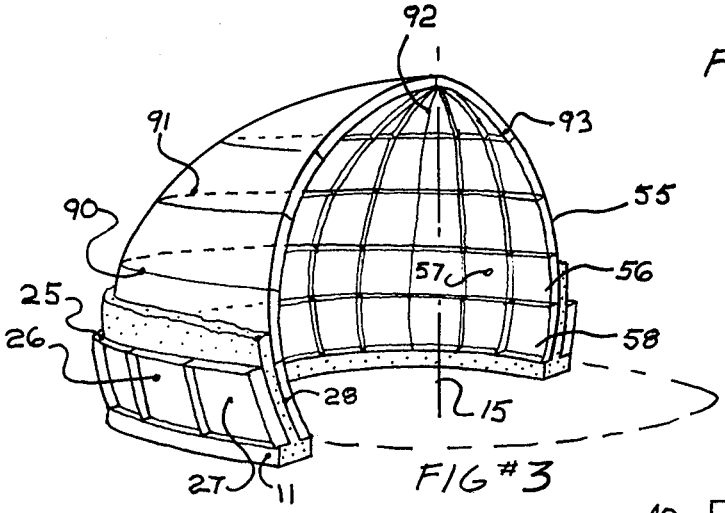
FIG #3
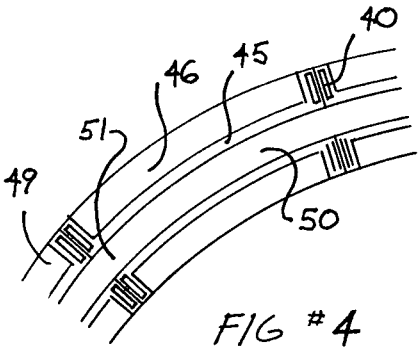
FIG #4
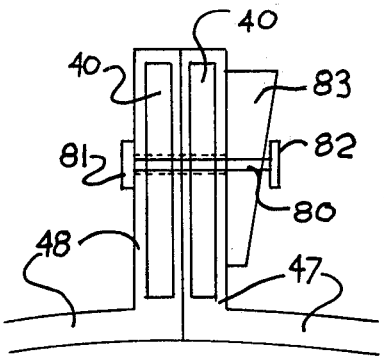
FIG #5

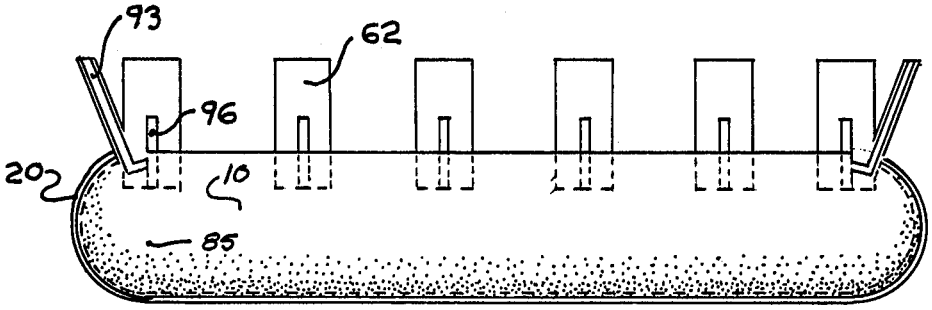
FIG #6
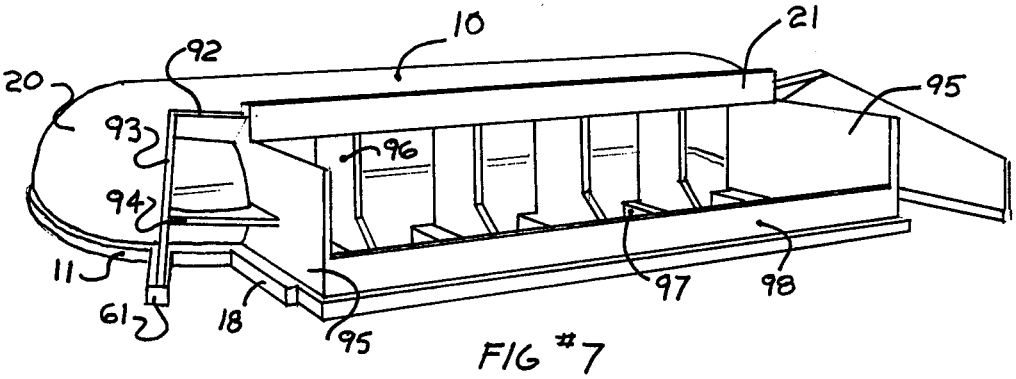
FIG #7
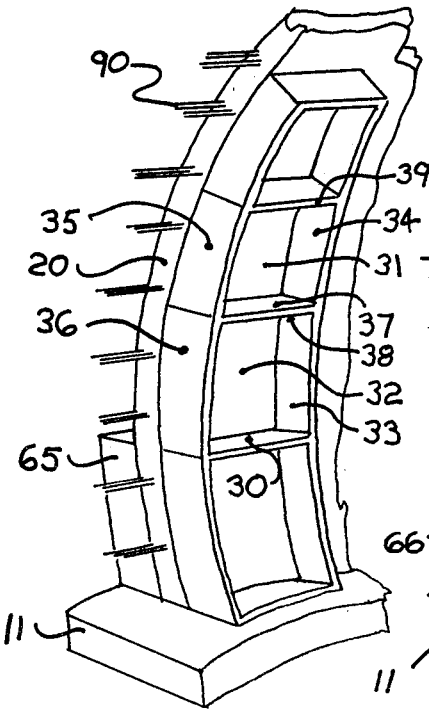
FIG #8
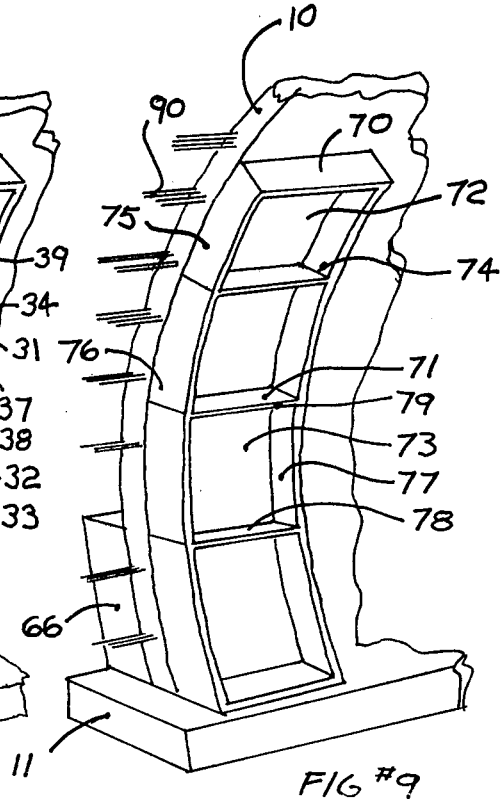
FIG #9

EARTH SHELTERED BUILDING TECHNOLOGY

This invention relates to building structures for earth sheltering, and particularly, to a forming system comprised of form networks of predetermined form panels, and methods of their use, to construct such buildings of a unique and useful design.

The building structures of this invention are useful for earth sheltering purposes, can be relatively simple and inexpensive to construct, and provide interior spaces which can be optimally utilized for habitation.

The need for easy to construct, inexpensive, and energy efficient buildings is well accepted. This need exists in residential, agricultural and other commercial areas. The earth sheltered building technology has evolved to meet the need for energy efficiency. The form panels, networks and methods of use to construct the buildings of this invention allow this technology to meet the remaining needs.

The earth sheltering of buildings provide difficulties and obstacles that are not encountered in conventional building construction. The additional forces exerted on a conventional rectilinear structure by earth sheltering requires expensive roof and wall reinforcement, which, simultaneously, decreases the space availability within the structure. Dome type structures, although well suited to distribute the load forces of earth sheltering, result in unduly high roofed buildings which are both expensive and poorly scaled for habitation.

The earth sheltered building structures of this invention utilize thin shell elliptoidal sections to meet the structural and interior space optimizing needs that exist. And, the use of predetermined form panels which can be easily assembled and disassembled on site into a form system of an elliptoidal space curved inner and outer form network allows these structures to be built in an economical manner.

The building structures of this invention particularly utilize the inherent qualities of an ellipsoid. Generally, the structures are of oblate spheroidal shape or that shape which results from an ellipse, a conic section having a major and minor axis, having been rotated about its minor axis. An ellipse can be defined as a path of a point that moves so that the sum of its distances from two fixed points or foci, located on the major axis, is constant. The eccentricity value of an ellipse measures its deviation from circular shape and is calculated by dividing the distance from the center of an ellipse to either focus point by one half the length of its major axis. The structures of this invention utilize a range of eccentricity values that have been found best suited for these particular earth sheltered structures.

The thin shelled elliptoidal structures of this invention are constructed or permanently placed on a preconstructed curved or a curved-linear foundation depending upon the type and/or size of structure desired. By utilizing the form system of this invention, the structure can be easily and quickly built on this foundation.

The form system placed on the foundation creates concavo-convex cavities into which a suitable building material can be placed or poured. These cavities are created by the use of an inner form network and an outer form network which project upward from the foundation in a spacially parallel and elliptical manner.

The inner and outer form networks are, respectively, constructed of a plurality of predetermined individual form panels. A method of utilizing these panels to construct inner and outer form networks in a manner which allows a building to be constructed in a concentric strata for on site use in part of the invention.

The use of the forming system of this invention can result in a building structure of generally elliptoidal shape or can be elongated by the placement of an elliptically shaped vault section between and congruous with two hemi-elliptoidal shell sections.

The omission of predetermined concavo-convex cavities in the forming system provide apertures in the resultant thin shell structures to provide ingress and egress means. These apertures are easily placed and defined by the longitudinal or meridian lines, latitudinal or parallel lines, or planes therethrough of the elliptoidal shapes of the components of this invention.

Other benefits of this building design and form system will be described by reference to the drawings, wherein:

FIG. 1 is a schematic cross sectional view of a typical vault section of a structure of this invention;

FIG. 2 is a schematic cross sectional view of a typical outer form panel used to construct the outer form network of the invention;

FIG. 3 is a schematic perspective cut away view of a typical elliptoidal shell section of the invention;

FIG. 4 is a schematic cross sectional view of a portion of the forming system made of the inner and outer form networks of this invention;

FIG. 5 is a schematic cross sectional view of connecting means used to construct a typical portion of the outer form network from two predetermined individual outer form panels;

FIG. 6 is a top viewed plan of a structure utilizing the elliptoidal vault section congruous and between two hemi-elliptoids;

FIG. 7 is a perspective view of the building of FIG. 6;

FIG. 8 is a schematic isometric cut away view of a typical inner form network of inner form panels of the elliptoidal shell section of a building structure of this invention; and, FIG. 9 is a schematic isometric cut away view of a typical inner form network section of inner form panels of the elliptoidal vault section of a building structure of this invention.

Referring to FIGS. 1 and 3, a thin shell 10 of a suitable building material such as reinforced concrete is shown. Shell 10 is of an elliptical vertical cross section of a vault section of a building structure of this invention. The elliptical contour shown in FIG. 1 represents a congruous surface continuation of a any vertical shell cross section of the hemi-elliptoidal structure shown in FIG. 3. Thus, the vault section can in an elliptically cross sectioned congrous manner extend from any vertical section of a hemi-elliptoidal shell.

For purposes of clarifying the elliptoidal nature of the building structures, inner and outer form panels, inner and outer form networks and forming system of this invention, line 15 of FIG. 1 represents the minor axis of the ellipse shown, and line 16 represents its major or equatorial axis.

Foundation 11 upon which shell 10 rests, waterproofing and insulating layer 12 and earth sheltering material 13 are also shown in FIG. 1. Slab floor 14 and an apertured plane 17, to allow ingress and egress through shell 10 are also indicated. A butress top 19 and a foundation 18 for a butress are shown to complete the ingress and egress means or aperture 17.

FIG. 3, also for clarifying purposes, shows latitudinal or parallel lines 90 and 91, and longitudinal or meridian lines 92 and 93. These lines are especially helpful in understanding the nature of the ingress and egress means through the thin elliptoidal shells of this invention. For example, door or window spaces can be defined by the intersection of any pair of longitudinal lines with a pair of latitudinal lines. And the larger apertured intrusions into the shell, as shown by the cross section of plane 17 in FIG. 1, can be defined as a meridian plane of the elliptoidal shell 10 or as a plane parallel to a meridian plane of the shell.

As can be seen in FIG. 1, the cross section of the elliptoid shown represents an oblate spheroidal section or, more precisely, an ellipsoid formed from the rotation of the ellipse about minor axis 15. The relationship of the major and minor axial dimensions of an ellipse define the eccentricity value of a particular ellipse as stated above. It has been found that for maximal force distribution purposes due to the earth sheltering forces exerted on the shell while maximizing the interior spaces with the building structure that eccentricity values ranging from 0.50 to 0.95 be utilized. The specific value depends, of course, on the foundational dimensions of the structure. One structure that has been tested involved an ellipsoid having a diameter of 6.1 meters and an eccentricity value of 0.75.

The understanding of the elliptoidal nature of the building structures of this invention also clarifies the understanding of the predetermined inner and outer form panels, inner and outer form networks and the form system utilized to manufacture these buildings. Necessarily, the elliptical vertical cross sections of the panels, networks and system have generally the same eccentricity values as that described in the resultant building structure.

Inner form panels 56, 57 and 58 are shown in FIG. 3 as parts of inner form network 55. Likewise, outer panels 26 and 27 resting at foundation 11 of FIG. 3 are parts of a stratum 25 of the outer form network. Although the inner form network of the form system of this invention can be totally constructed in one unit, the outer form network is assembled in a series of strata. This aids in the pouring or placement of building material into the concavo-convex cavities 28 that result between the inner and outer form networks. Thus, as can be understood from FIG. 3, once the lower stratum of the outer form network 25 is secured a building material such as concrete can be poured into the concavo-convex cavity formed between it and the inner form network 55. When the concrete is in place up to the top of the stratum 25, the form network can be shook to remove any air entrapped in the concrete. Subsequently, another stratum of the outer form network can be concentrically attached to stratum 25 and additional concrete can then be poured. It should be noted, that at a particular height, the outer form network is no longer required in that the concrete will rest on top of the inner form network.

FIG. 2 shows a cross sectional view of a typical outer form panel having a curved face member 45, two longitudinal flange members 46 and core or stiffening members 40 embedded in the flange members. The form panels are constructed of a noncohesive material so that the panels do not adhere to the building material, and can, therefore, be easily removed after use. This also allows the form panels to be repeatedly used. As is known, a Fiberglass surface is well suited for panel material when the building material is concrete. The inner form panels are similar in construction except that the outside surface of the face member is convex in cross section rather than concave, as in the case of the outer form panels.

FIG. 4 illustrates a cross sectional view of a portion of the forming system. Outer form panels 45 and 46 are connected to result in the outer form network, and below building material 50 adjoining inner form panels are shown as the inner form network to complete the portion of the form system. Space retaining means 51 is used to maintain the desired distance between the inner and outer form networks so that a shell of uniform thickness is produced when building material 50 is placed therebetween. A typical and know method to gain this result is the use of a pin 51 as shown in FIG. 4.

Form panel connecting means are shown in FIG. 5. The means shown are known in the construction industry, and represent a tie-rod or pencil 80, heads or buttons 81 and 82, and wedge or head pin 83. Tie-rod 80 protrudes through apertures in adjoining flange members 47 and 48 of the form panels. Head 81 is permanently attached to one end of tie-rod 80 while head 82 is screwed onto the other end which is threaded to receive it. Wedge 83 fits into a longitudinal slot in tie-rod 80 so that it can be forced into that slot and thereby causing the adjoining flange members through which the tie rod is placed to be secured in place in the form network.

As can be seen in FIG. 5, tie-rod 80 also protrudes through core or stiffening members 40 in the flange members. It has been found necessary to place members 40 into the remaining Fiberglass panel structure for support purposes needed when concrete is poured between the form networks to ensure that the respective networks do not move due to the resultant weight. The panel connecting means shown in FIG. 5 for the outer form network is also used to assemble the inner form network.

FIG. 8 illustrates a portion of an inner form network attached to foundation 11, and made of predetermined form panels 31 and 32 to construct an elliptoidal shell portion for the hemielliptoidal section of the building structure of this invention. This shell portion is represented by element 85 in FIG. 6.

FIG. 9 illustrates a portion of an inner form network attached to foundation 11, and made of predetermined form panels 72 and 73 to construct an elliptoidal shell portion for the vault section of the building structure shown in FIG. 6. This shell portion is represented there by element 62.

As can be seen in FIGS. 8 and 9 flange members 34 and 35 of panel 31 and flange members 33 and 36 of panel 32 are on longitudinal or meridian lines of the elliptoidal cross sectioned shell 20 and are non-parallel to one another (i.e., flanges 34 and 35). Flanges 74 and 75 of vault panel 72 are generally parallel to one another, as are flanges 76 and 77. It must again be noted that the vault shell portion is congrous with the abutting elliptoidal shell section of FIG. 8. FIGS. 7 and 8 illustrate the congruity of the shell in the shown vaulted building structures.

Outer form panel 65 in FIG. 8, and outer panel 66 in FIG. 9 represent the lower stratum of the outer form network. As can be seen, building material 20 shown in FIG. 8 and building material 10 in FIG. 9 results from the concavo-convex space within the forming system. These building materials, when set form the congruous thin shell of elliptical cross section of this invention. As shown in FIGS. 8 and 9 the building material is reinforced concrete. Experience has shown that 3 reinforcing bars 90 are well suited in conjunction with about an 11.5 cm. thick shell. The reinforcing bars are initially placed within the concavo-convex cavities formed by the inner and outer form networks before the concrete is poured within the cavity.

Furthermore, it has been found that by using a maximum spacing of 30.5 cm. of 3 reinforcing bars in a longitudinal/latidinal grid system between the inner and outer form networks a shell results which is suited for a 45 cm earth cover. This embodiment also utilized 3 tie in bars from the foundation and 4 reinforcing bars around ingress and egress apertures in the shell.

As shown in FIGS. 6 and 7 of the drawings, the utilization of elliptoidal thin shell segments ca result in variety of useful and habitable structures for earth sheltering. The buildings shown in these figures make use of the elliptically cross sectioned vaults which congruously merge into the thin shells of two opposing hemispheroidal sections. To complete these particular structures, butress 96, butress foundation 97 and a transfer beam to reinforce the large aperture into the shell section are added.

As many changes are possible utilizing the teachings of this invention, the description above and accompanying drawings should be interpreted in the illustritive and not in the limited sense.

That which is claimed is:

1. A reusable construction form system for assembly and disassembly relative to a preformed foundation surface at a building site, said form system for producing ellipsoidal cavities to receive building material in the construction of a generally curvilinear thin shelled building structure for an earth sheltered building onto the preformed foundation surface, said form system being disposed to produce ellipsoidal cavities having a vertical cross section of an elliptical configuration with an eccentricity value ranging essentially from 0.50 to 0.95, said form system comprising:

(a) an inner form network of a plurality of differing, predetermined inner form panels, said inner form panels varying in configuration and being placable at predetermined locations in said inner form network as determined by the location relative to the preformed foundation surface, said inner form network having an outward facing non-cohesive convex surface which extends generally upward from a generally inner edge of said foundation surface, said outward facing surface of said inner form network further having a vertical cross section of an elliptical configuration having an eccentricity value which ranges essentially from 0.50 to 0.95 to form an inner ellipsoidal structure, and, (b) an outer form network comprising a plurality of detachably mountable strata of predetermined outer form panels, said outer form network having a generally continuous, non-cohesive concave surface running generally spacially parallel to said convex surface of said inner form network to form an outer ellipsoidal structure.

2. The form system of claim 1 wherein said non-cohesive surfaces of said inner and outer form networks are Fiberglass.

3. The form system of claim 6 wherein said concavo-convex cavities are filled with reinforced concrete.

4. The form system of claim 1 wherein said elliptically cross sectioned inner and outer form networks are detachably mounted to the foundation surface at cross sectional points below the major axis of their respective elliptical shapes.

5. A light weight, and reusable construction form panel for predetermined placement into a construction form network having a vertical cross section of an elliptical configuration having an eccentricity ranging essentially from 0.50 to 0.95 for constructing an ellipsoidal, thin shelled building for habitation, said form panel comprising:

(a) a curved face member having an inner and outer surface and a vertical cross section of an elliptical configuration which represents a section of an ellipse having an eccentricity value which ranges essentially between 0.50 to 0.95 to form an ellipsoidal structure, one of said face surfaces being non-cohesive with the building material to be used in the construction, and, (b) flange members projecting generally outward from the periphery of said non-cohesive surface of said face member, said flange members for structural and connective purposes to permit easy assembly and disassembly with other predetermined, and differing panel members at a building site to construct the form network.

6. The construction form panel of claim 5 wherein said flange members additionally have connecting means so that the flange members can be detachably secured to abutting flange members of other predetermined form panels in the form network.

7. The construction form panel of claim 5 wherein said flange members additionally have core members attached thereto to strengthen said panel for connective purposes.

8. The construction form panel of claim 5 wherein said non-cohesive surface is Fiberglass.

9. The construction form panel of claim 6 wherein said connecting means are comprised of apertures extending through said flange members, for receiving a tie-rod member for extension therethrough and through an aligned aperture of an adjacent form panel member flange.

10. The construction form panel of claim 9 wherein said tie-rod member has a head member at one end and an elongated slot in the other end, said slot in said other end to receive a wedge member to securely abut adjacent panel members, whereby, said panel members can be easily assembled at a construction site to construct said form network.

* * * * *